US006604928B1

(12) United States Patent
Wnuk et al.

(10) Patent No.: US 6,604,928 B1
(45) Date of Patent: Aug. 12, 2003

(54) FILTERING DEVICE AND SPINNING HEAD

(75) Inventors: Ralf Wnuk, Bexbach (DE); Norbert Lang, Blieskastel (DE); Jurgen Hausdorf, Saarbrucken (DE); Markus Reichwein, Huckeswagen (DE); Roland Nitschke, Hagen (DE); Jorg Alexander, Remscheid (DE); Stefan Becker, Wipperfurth (DE)

(73) Assignees: Hydac Process Technology GmbH, Neukirchen (DE); Barmag Aktiengesellschaft, Remschied (DE)

( * ) Notice: Subject to any disclaimer, the term of this patent is extended or adjusted under 35 U.S.C. 154(b) by 0 days.

(21) Appl. No.: 09/700,308

(22) PCT Filed: Jun. 2, 1999

(86) PCT No.: PCT/EP99/03814

§ 371 (c)(1),
(2), (4) Date: Nov. 14, 2000

(87) PCT Pub. No.: WO99/64648

PCT Pub. Date: Dec. 16, 1999

(30) Foreign Application Priority Data

Jun. 8, 1998 (DE) ..... 198 25 532

(51) Int. Cl.[7] ..... D01D 4/06; B01D 39/10

(52) U.S. Cl. ..... 425/198; 425/382.2; 425/464; 210/456; 210/460; 210/461; 210/499

(58) Field of Search ..... 425/382.2, 72.2, 425/198, 464, 66; 210/437, 455, 456, 460, 461, 487, 497.2, 499

(56) References Cited

U.S. PATENT DOCUMENTS

| | | | | |
|---|---|---|---|---|
| 2,881,474 A | | 4/1959 | Sellers et al. | 425/192 R |
| 3,762,850 A | * | 10/1973 | Werner et al. | 425/198 |
| 4,276,011 A | * | 6/1981 | Siegman et al. | 425/198 |
| 4,661,249 A | * | 4/1987 | Langley | 210/266 |
| 5,513,973 A | * | 5/1996 | Keil et al. | 425/382.2 |
| 5,601,854 A | | 2/1997 | Schroeder et al. | 425/192 S |

FOREIGN PATENT DOCUMENTS

| | | |
|---|---|---|
| DE | 159886 A | 4/1983 |
| DE | 234693 A | 4/1986 |
| DE | 252013 A | 12/1987 |
| DE | 4225341 | 2/1993 |
| DE | 4227114 | 3/1993 |

* cited by examiner

*Primary Examiner*—Robert Davis
*Assistant Examiner*—Joseph S Del Sole
(74) *Attorney, Agent, or Firm*—Roylance, Abrams, Berdo & Goodman, LLP

(57) ABSTRACT

A filtering device for a spinning head for producing plastic threads. The spinning head has a housing in which the plastic melt flows through a filter element under pressure before exiting the spinnerets. The filter element is provided with a filtering material that is subjected to an axial contact pressure through a distributor device, according to the degree of pressure of the melt. This contact pressure acts upon the sealing edges of the filter element to close the sealing gaps. The special geometrical configuration of the filter element and/or its elasticity guarantee advantageous filtering in terms of energy. The filtering system is resistant to pressure and provides good, permanent sealing.

32 Claims, 3 Drawing Sheets

FILTERING DEVICE AND SPINNING HEAD

FIELD OF THE INVENTION

The present invention relates to a filtering device for a spinning head and a spinning head for the manufacture of plastic threads. Plastic melt flows in a housing through a filter element with filtering material before being discharged under pressure through the spinnerets. The filter element has a filtering material subjected through a distribution device to an axial pressing force dependent upon the strength or intensity of the pressure of the melt. For closing of sealing gaps, the axial pressing force works on the sealing edges of the filter element.

BACKGROUND OF THE INVENTION

With melt-spinning, the polymer melt must be subjected to a super-fine filtration by a sand filter, a metal powder filter or filter cartridges immediately before passage through the spinneret plate. EP 0 658 638 B1 discloses conducting the polymer melt through a plurality of metal gauze filter cartridges arranged parallel to one another. Disadvantageously, uniform flow through all of the filter cartridges is practically impossible, with the result that certain individual filter cartridges become polluted before the others. Entire sets of filter cartridges must be cleaned or exchanged following short operation times.

With a spinning head of the type shown in DE 42 25 341 A1, one single annular filter element is used and surrounds or encloses a mixed operation device in the interior of the housing. This arrangement serves to bring together the filtered melt flow which has been homogeneously and thoroughly mixed coming out of the filter. However, the conventional filter element is not sufficiently pressure-stable and the elasticity of the stretched out filter element does not suffice to close over its sealing edges to form a complete sealing of those potential passage points present in the form of sealing gaps. In order to overcome this drawback, presently the annular filter element has been replaced by plate filter packs. However, disruptive energy flow behavior arises as a result of the reorientation of the melt flow within the filter element with its plate filter disks when such a reorientation is thus required. The reorientation hinders the relevant filtering process for the plastic melt. Also, such a solution is costly in realization.

DE 42 27 114 discloses a spinning head whereby the stability of the annular filter element is increased on the basis of radial support obtained by a distribution device. However, its filter element allows only a very uneven flowthrough.

U.S. Pat. Nos. 4,661,249 and 2,881,474 disclose filter elements each incorporating a support pipe which has built-in fluid outlets in the walls surrounded or enclosed by a filtering material. The filter element in this case is stretched tightly around the ends in the housing parts of the filter device. At the ends, the sealing attained exists only within the range of predeterminable sealing values. Because of the static stretching, settling within the seals and a loss of seal effectiveness results.

SUMMARY OF THE INVENTION

Objects of the present invention are to provide an improved filter device for a spinning head, which allows energy-saving filtering operation, which is pressure-stable, which guarantees a good duration of the seal and which is of low cost in its realization.

Other objects of the present invention are to provide a spinning head in which a particularly homogenous plastic melt for the production of a multi-strand synthetic thread appears at the point of discharge.

The foregoing objects are obtained where the filter element, formed as an exchangeable structural unit, includes a support pipe with built-in fluid outlets in the wall. The support pipe is surrounded or enclosed by the filtering material. The filter material projects out axially at one end and/or is displaced axially rearward at least at one end, with its sealing edge over the support pipe. A pressure-stable structural unit is thus formed, which is operationally secure even when working with high melt pressures. Since the plastic melt flows in the direction of and uniformly over the entire length of the filter element in one direction, the flowthrough is opposed or contrasted without waste of energy. No artificial resistance is built up counter to the melt flowthrough. Through the projecting end or the rearwardly aligned end of the filtering material, which forms the relevant sealing edge, with the given elasticity behavior of the filter element, secure sealing of the possible passage points in the form of potential fissures in the seal is guaranteed. Since such a filter element can be manufactured of standard structural parts, especially of traditional metal gauze filtering materials, the filter element is of low cost to manufacture.

Since at least at one end, a flat sealing edge can be present in the case of the filter element, the overall rigidity of the filter element is enhanced. The closing of the sealing gap occurs under the force of the pressure being exerted. Dependent upon the pressing force, a pro-actively working sealing arrangement is thus realized for the filtering device with the spinning head, which seals progressively more tightly with application of progressively increasing pressure.

The spinning head according to the present invention is characterized especially in that the plastic melt is guided uniformly in its movement from the inlet all the way to the discharge and without remaining for different lengths of time in different areas. The output chamber formed between the melt passage support pipe and the distribution head guarantees uniform flowthrough through the filter element and unhindered carrying and removal of the filtered plastic melt to the discharge point. A high degree of pressure stability of the filter element is attained because of the support pipe.

In order to obtain a favorable flow passage, it is especially advantageous to widen the open flowthrough diameter of the output chamber by conical tapering of the distribution head in the direction of the discharge.

In order to improve the inlet passage of the plastic melt from the side into the filter element, a bottom of the pressure plate can be phased in on the displacement device between the pressure plate and the distributing head. The pressure plate operates as a sealing surface with the sealing edge of the filter element. Flow accumulation angles which are disadvantageous to the operation are thus avoided.

For this purpose, the bottom of the pressure plate is preferably inclined at an angle of from 0° to 40° in the direction of discharge of the plastic melt in the spinning head.

For the melt at the ends of the filter element, and especially at the end of the filter element turned facing or adjacent the pressure plate, to flow smoothly and without remarkable hindrance into the filtering material, a cylindrical filter cover is connected to both the support pipe and the filtering material. The seal surfaces of the filter element are constructed at the end of the cover. Especially advantageously, the filtering material at the end of the filter element turned toward or adjacent the pressure plate project out axially with its sealing edge over the support pipe or else be angled rearward, so that accumulation angles no longer occur.

The elasticity of the filter cover surprisingly is not limited by the radial stability of the support pipe. Through the fluid passages in the support pipe, the filter cover has an axial elasticity which under the axial pressing force pro-actively supports or assists with the closing of the sealing gaps around the sealing edges of the filter element. The elasticity of the filter element can thus be enhanced and increased, while the filter element does not have at its disposal traditional end caps of correspondingly rigid material. Rather, the elasticity is attained solely by consolidation of the filtering material and corresponding fusing or welding of the ends.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIGS. 2*b* and 2*c* are enlarged, partial, side elevational views in section of the areas X and Y, respectively of FIG. 2*a.

DETAILED DESCRIPTION OF THE INVENTION

Figure 1:
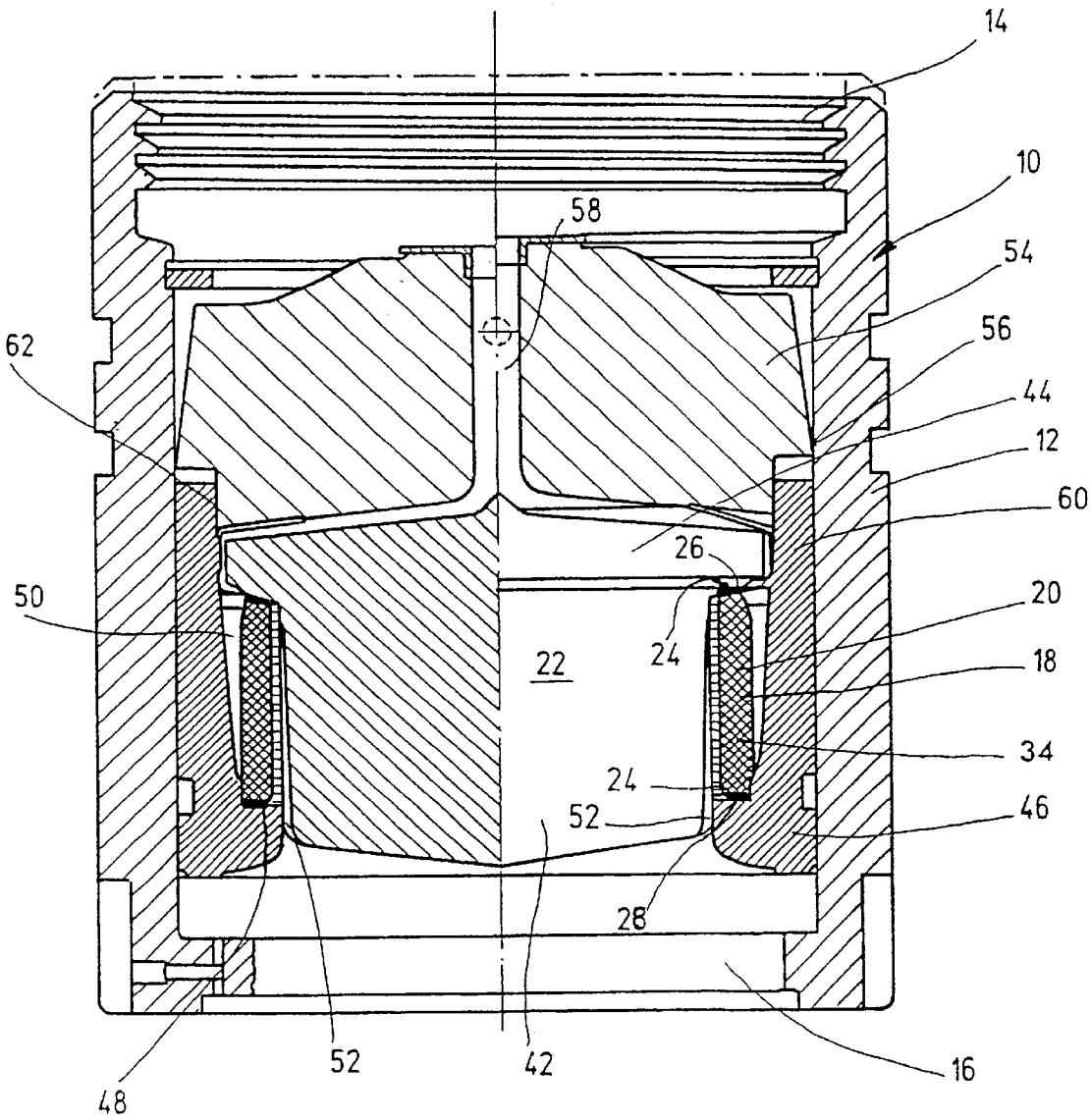
FIG. 1 is a side elevational view in section of a spinning head with a filter device according to the present invention.

In FIG. 1, a spinning head 10 for the manufacture of plastic threads from a plastic melt, especially from a polymer melt, is shown. Spinning head 10 has a housing 12 in the form of a hollow cylinder with a top inlet opening 14 for the inflow of the plastic melt and with a bottom discharge opening 16 accommodating a spinneret. The spinneret can discharge the filament of a multi-strand synthetic thread, and includes numerous nozzle bores (not shown). For the manufacture of the plastic filament, the bottom discharge opening 16 is closed off in a conventional manner with a spinneret plate. Therefore, the spinneret plate is not described in greater detail herein. In the detailed view shown in FIG. 1 on the right half of the image, the spinning head is represented in a discharge setting. In the left half of the image the spinning head is represented in the operation setting, in which under the pressure and force of the plastic melt the movable parts of spinning head 10 are represented in their operational position.

Figure 2:
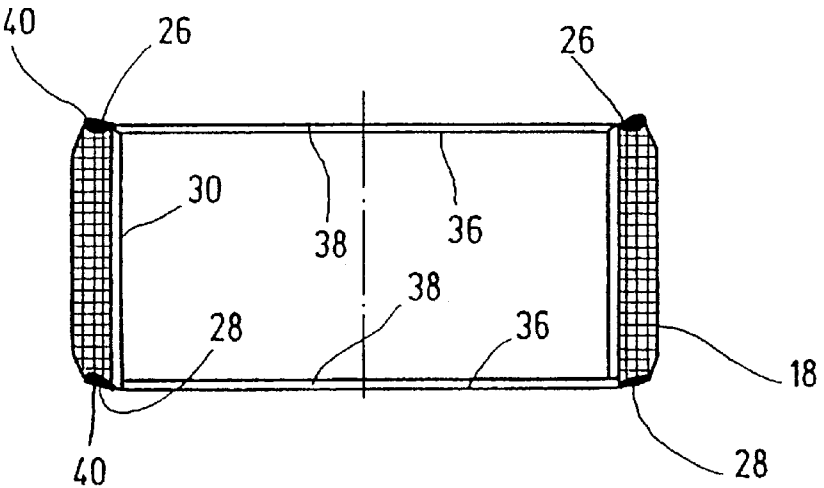
FIG. 2 is a side elevational view in section of the filter element with a support pipe and filtering material according to a first embodiment of the present invention.
Figure 3:
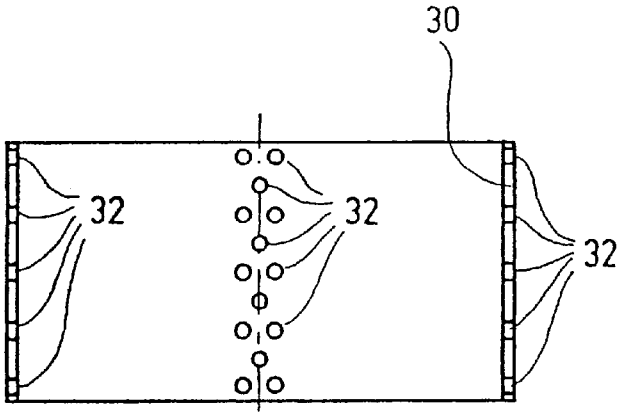
* and FIG. 3 is a side elevational view in section of the support pipe of FIG. 2.

For a filtering process of the plastic melt before its discharge from the spinnerets, over the spinneret plate under pressure, this melt is guided or conveyed through a filter element 18 having filtering material 20. The flow through the filter element occurs radially from the exterior inward. Such filter element 18 is shown in an improved representation in FIG. 2. Filtering material 20 is subjected to the effect of an axial pressing force coming from a distributor device 22 dependent upon the strength or intensity of the melt pressure. For closing of sealing gaps 24 as possible passage points for the plastic melt, the axial pressing force works on the sealing edges 26 and 28 of filter element 18. Filter element 18, with formation of an exchangeable structural unit, as is shown in FIG. 2, has a support pipe 30 with fluid passages 32 for the plastic melt. FIG. 3 shows support pipe 30. Not all of the passage points 32 are indicated. However these passage points, associated with one another in groups of three, are distributed uniformly along the exterior periphery of cylindrical support pipe 30.

Filtering material 20 surrounds or encloses, and thus, maintains contact with support pipe 30 itself. As is further shown in FIG. 2, filtering material 20 in the alignment shown in the drawing projects at the top end with its sealing edge 26 aligned axially forward over support pipe 30 and projects at the bottom end aligned axially rearward.

Filtering material 20 preferably comprises a pleated filter cover 34 of wire gauze or of a metallic non-woven fabric, especially in the form of high-quality steel. For the connection of the cover ends, these ends are connected with one another by a longitudinal weld seam (not shown) forming a cylindrical hollow body. Instead of being pleated, the filter cover can also be wound in one or more layers around support pipe 30 (not shown). With the illustrated embodiment, filter cover 34 comprises a multi-layered, high-quality steel gauze with a filter fineness of between 5 micrometers and 500 micrometers, especially between 50 and 150 micrometers. The filtering material is also commercially available under the trade name "Chemicron". When filter cover 34 is pleated, for each fold in the filter, an independent sealing edge 26, 28 is obtained on each opposite end side of filer cover 34. In addition to a pleated construction of filter cover 34, this embodiment can also include a cylindrical filter cover passing through with flat exterior periphery. Furthermore, the relevant filtering material 20 can form one piece of or one part of it can form filter cover 34, whereby support pipe 30 is an integral component part of the entire filter element. It is also possible, with a not shown embodiment, that support pipe 30 can be entirely deleted and a support frame can be formed exclusively by the filter element cylinder.

Filter cover 34 has predeterminable elasticity. Under the axial pressing force during the filtering process, in other words during the operation of spinning head 10, the elasticity can assist with the closing of the relevant sealing gaps 24 in sealing edges 26 and 28 of filter element 18. Furthermore, as shown in FIG. 2, the sealing edges 26 and 28 of filter element 18 are inclined in relation to the end circular plane 36 of support pipe 30. Particularly, they are inclined outward at a predeterminable angle, especially about 15°, in the direction of the flow of the plastic melt into spinning head 10. Two radial sealing gaskets 38, parallel to the cited circular planes 36, as shown in FIG. 2 are correspondingly sealed with a filter cover 34. The gaskets are configured to be disk-shaped and are present for this purpose. Such a sealing occurs even when the filter cover, as already described, is configured to be a hollow cylinder. The exterior peripheral sealing is accomplished by sealing edges 26 and 28. An effective sealing effect and sealed packing is attained by support pipe 30 cooperating with filter cover 34, so that overall the filter element 18 produces the sealing effect.

Therefore, for the purpose of manufacture, the sealing edges 26 and 28 of filter element 18 in turn are formed by a peripherally sealed seam 40, as seen in FIG. 2. Seams 40 completely cover the visible ends along the pleated folds of filter cover 34. Peripheral weld seam 40 is then reworked by grinding, abrading or sharpening or the like in such a manner that sealing edges 26 and 28 run along a closed peripheral curve to guarantee that it continues to maintain a smooth surface for sealing.

Distributor device 22 has a distributor head 42 with a pressure plate 44 located above it. Distributor head 42 is guided longitudinally movably within housing 12 within a cylindrical support installation 46. Filter element 18 thereby surrounds and encloses the exterior periphery of the distributor head 42 and is supported with one end on the bottom of pressure plate 44 and the other end on a projection 48 from support installation 46. The bottom of pressure plate 44 and the top of projection 48 are therefore also provided with an angle of inclination which corresponds to the angle of inclination of sealing edges 26 and 28, and preferably is 15° as compared with the horizontal line.

However, the bottom of pressure plate 44 can be configured with an angle of inclination of 0°. Thus, a not shown sealing ring can also be used for the sealing of the sealing gap 24. The sealing ring would be arranged between sealing edge 26 of the filter element and the seal surface of distribution device 22.

Figure 2A:
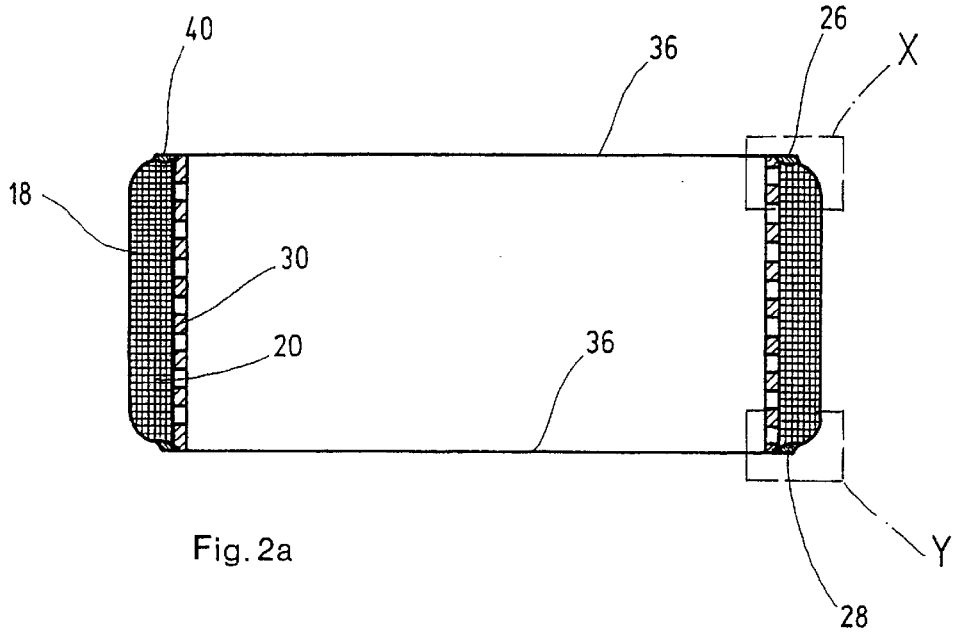
FIG. 2*a* is a side elevational view in section of a filter element with a support pipe and filtering material according to a second embodiment of the present invention.
Figure 2B:
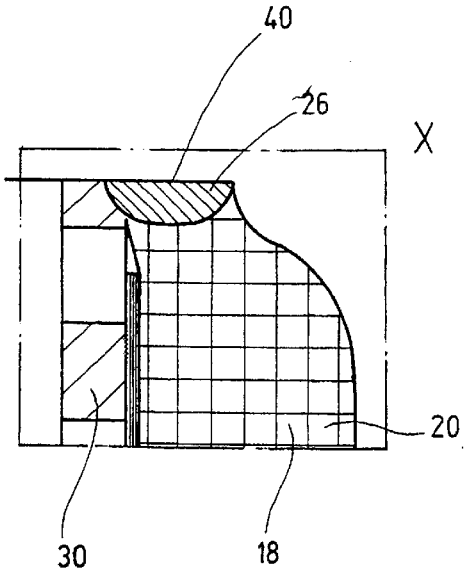
Figure 2C:
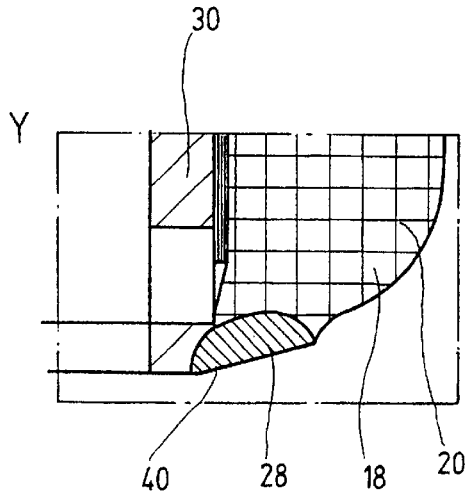

For such a configuration, however, it is especially advantageous to use a filter element as illustrated in FIG. 2*a* without a separate sealing ring. For this second embodiment of the filter element, the same references are used as for the previously described, first embodiment of the filter element. In addition, this new embodiment is explained only insofar as it differs essentially from the first embodiment. As particularly shown by the enlarged separate drawing Y of FIG. 2*c,* in the direction of viewing in the drawing, the bottom sealing edge 28 is arranged axially angled rearward in relation to support pipe 30. At the other end of filter element 18, as shown in the enlarged separate drawing X of FIG. 2*b,* the sealing edge 26 is arranged running flat, in other words in a horizontal plane lying together with the associated free end of support pipe 30. The total rigidity of filter element 18 of FIG. 2*a* is measured in such a manner that, under the increasing and eventually constant pressing force of the spinning head and particularly of its pressure plate 44, the closing of sealing gap 24 is executed until it reaches the maximum sealing effect. Consequently, a secure sealing is attained in the area of the round weld seams, which essentially form the sealing edges 26 and 28.

The exterior periphery of filter element 18, with the support installation 46, limits an admission chamber 50. Admission chamber 50 is measured volumetrically in such a manner that any possible dead space is so limited as to be quite small. Support pipe 30, with distributor head 42, in turn limits an output chamber 52 for the plastic melt. Output chamber 52 also comprises individual longitudinal channels arranged in its longitudinal alignment so that space 52 can extend over the entire height of support pipe 30. While admission chamber 50 as seen in the direction of viewing in FIG. 1 is tapered conically from the top downward, output chamber 52 is widened conically from the top downward. This tapering leads to optimum flow behaviors with the flowthrough of filter element 18, with simultaneous depletion of the dead space.

Distributor head 42 works in the traditional manner together with a control head 54. The control head is guided longitudinally movably in housing 12 along its interior wall. With increasing setting movement in the direction of distributor head 42, the control head undertakes a side edge sealing 56 in relation to housing 12. For the feed of the plastic melt on pressure plate 44, control head 54 has a midline recess 58. The plastic melt is distributed from recess 58 outward uniformly over the top of pressure plate 44. Passing through a peripheral longitudinal channel guide 60, the plastic melt passes from the channel guide out into admission chamber 50. Control head 54, as compared with distributor head 42, is supported over a springy elastic spacing holder 62, as a sort of a partial segment of a plate spring. Such a space holder can be supported correspondingly with its bottom end in turn on a border flange of support installation 46 or on distributor head 42 in order to limit the path of control head 54.

With the setting movement of control head 54 from its right, non-operational position into the left operational position, the control head moves for a predeterminable distance. If, following surmounting of the free spring passage of spacing holder 62, the force in connection with the pressure force of the plastic melt on pressure plate 44 moves distributor head 42 downward, this movement provides an increased clamping force on sealing edges 26 and 28 of filter element 18. Also, sealing gaps 24, while possible passage points between distributor head 42 and filter element 18 or else between element 18 and support installation 46, are securely closed and sealed. By means of the elasticity of such a stretched filter element 18, the increased seal effect with a proactive deformation of the sealing itself is then attained.

While various embodiments have been chosen to illustrate the invention, it will be understood by those skilled in the art that various changes and modifications can be made therein without departing from the scope of the invention as defined in the appended claims.

What is claimed is:

1. A filtering device for a spinning head for manufacturing plastic threads, comprising:

a housing for conveying plastic melt for discharge from spinnerets under pressure;

an exchangeable filter element having a filtering material through which the plastic melt flows and sealing edges at opposite ends thereof, said filter element including a support pipe with built-in fluid passages, said support pipe being surrounded by said filtering material, said filtering material projecting outwardly and axially from at least one axial end thereof over said support pipe or is angled rearwardly; and a distributor device subjected to an axial pressing force dependent upon strength or intensity of plastic melt pressure and applying such axial pressing force to said sealing edges of said filter element to close sealing gaps.

2. A filtering device according to claim 1 wherein said filtering material comprises a pleated filter cover of wire gauze with facing ends connected by a longitudinal welded seam.

3. A filtering device according to claim 2 wherein said filter cover has elasticity properties assisting in closing of the sealing gaps at said sealing edges of said filter element under the axial pressing force.

4. A filtering device according to claim 1 wherein at least one of said sealing edges is inclined relative to an end circular plane of said support pipe at an incline angle from 0° to 40° in a plastic melt flow direction in the spinning head.

5. A filtering device according to claim 4 where said incline angle is 15°.

6. A filtering device according to claim 2 wherein each of said sealing edges is a peripheral weld seam completely covering a respective axial end of said filter cover.

7. A filtering device according to claim 6 wherein each said peripheral weld seam is flat and extends along a closed peripheral curve arranged in folds.

8. A filtering device according to claim 1 wherein said distributor device comprises a distributor head and a pressure plate guided for axial movement within a support installation in said housing; and said filter element surrounds or encloses an exterior periphery of said distributor head, has one of said ends thereof on said pressure plate, and has the other end thereof on said support installation.

9. A filtering device according to claim 8 wherein an admission chamber is defined between an exterior periphery of said filter element and said support installation; and an output chamber is defined between said support pipe and said distributor head.

10. A filtering device according to claim 8 wherein a control head cooperates with said distributor head, is guided for longitudinal movement in said housing, and forms a seal with said housing with movement thereof toward said distributor head.

11. A filtering device according to claim 1 wherein said plastic melt is a polymer melt; and said filtering material comprises multi-layered wire gauze of a high quality steel.

12. A filtering device for a spinning head for manufacturing plastic threads, comprising:

a housing for conveying plastic melt for discharge form spinnerets under pressure;

an exchangeable filter element having filtering material through which the plastic melt flows, sealing edges at opposite ends thereof and a longitudinal axis, said filter element including a support pipe with built-in passages, said support pipe being surrounded by said filtering material, at least one of said sealing edges being flat and extending in a plane substantially perpendicular to said longitudinal axis; and a distributor device subjected to an axial pressing force dependent on strength or intensity of plastic melt pressure and applying such axial pressing force to said sealing edges of said filter element to close sealing gaps, said filter element having an overall rigidity such that under the axial pressing force the sealing gaps close due to elasticity of said filter element.

13. A filtering device according to claim 12 wherein said filtering material comprises a pleated filter cover of wire gauze with facing ends connected by a longitudinal welded seam.

14. A filtering device according to claim 13 wherein said filter cover has elasticity properties assisting in closing of the sealing gaps at said sealing edges of said filter element under the axial pressing force.

15. A filtering device according to claim 12 wherein at least one of said sealing edges is inclined relative to an end circular plane of said support pipe at an incline angle from 0° to 40° in a plastic melt flow direction in the spinning head.

16. A filtering device according to claim 15 where said incline angle is 15°.

17. A filtering device according to claim 13 wherein each of said sealing edges is a peripheral weld seam completely covering a respective axial end of said filter cover.

18. A filtering device according to claim 17 wherein each said peripheral weld seam is flat and extends along a closed peripheral curve arranged in folds.

19. A filtering device according to claim 12 wherein said distributor device comprises a distributor head and a pressure plate guided for axial movement within a support installation in said housing; and said filter element surrounds or encloses an exterior periphery of said distributor head, has one of said ends thereof on said pressure plate, and has the other end thereof on said support installation.

20. A filtering device according to claim 19 wherein an admission chamber is defined between an exterior periphery of said filter element and said support installation; and an output chamber is defined between said support pipe and said distributor head.

21. A filtering device according to claim 19 wherein a control head cooperates with said distributor head, is guided for longitudinal movement in said housing, and forms a seal with said housing with movement thereof toward said distributor head.

22. A filtering device according to claim 12 wherein said plastic melt is a polymer melt; and said filtering material comprises multi-layered wire gauze of a high quality steel.

23. A spinning head for manufacturing plastic threads, comprising:

a housing including a discharge side having a spinneret with a plurality of nozzle bores and including an inlet side having a control head with a melt inlet;

a support installation mounted in said housing;

a filter element between said control head and said spinneret, said filter element having first and second sealing edges on opposite ends thereof, said first sealing edge engaging a seal surface on said support installation, said filter element including an interior support pipe surrounded by and supporting filtering material, said support pipe having built-in passages; and a distributor device between said control head and said spinneret, said distributor device having a seal surface engaged by said second sealing edge of said filter element, having a pressure plate supported on said filter element and having a distributor head projecting into said filter element;

whereby, the distributor device and the filter element are held together against said support installation by melt pressure, and plastic melt flows through said filtering material before being discharged from said spinneret and is conducted by said distributor head to said spinneret.

24. A spinning head according to claim 23 wherein an output chamber between said support pipe and said distributor head is formed by a conical taper of said distributor head in a direction of discharge of plastic melt.

25. A spinning head according to claim 23 wherein said seal surface of said distributor device is between said pressure plate and said distributor head and is on a bottom of said pressure plate.

26. A spinning head according to claim 25 wherein said bottom of said pressure plate is inclined at an angle between 0° and 40° in the direction of discharge of plastic melt.

27. A spinning head according to claim 26 wherein said angle is 15°.

28. A spinning head according to claim 23 wherein said support pipe and said filtering material are connected to a cylindrical filter cover having said sealing edges on ends thereof.

29. A spinning head according to claim 28 wherein said filtering material projects axially at an end thereof adjacent said pressure plate, with said second sealing edge being over said support pipe.

30. A support head according to claim 28 wherein said filter cover has elastic properties assisting in closing of sealing gaps at said sealing edges of said filter element.

31. A spinning head according to claim 28 wherein each of said sealing edges of said filter element is a peripheral weld seam completely covering a respective axial end of said filter cover.

32. A spinning head according to claim 23 wherein said filtering material is pleated wire gauze or pleated fleece or fabric.

* * * * *